US008368316B2

(12) United States Patent
Yinn et al.

(10) Patent No.: US 8,368,316 B2
(45) Date of Patent: Feb. 5, 2013

(54) LED CIRCUIT AND OPERATION METHOD OF THE SAME HAVING MINIMUM OUTPUT VOLTAGE SELECTION MECHANISM TO GENERATE FEEDBACK VOLTAGE

(75) Inventors: Aung Aung Yinn, Sinshih Township, Tainan County (TW); Chow-Peng Lee, Sinshih Township, Tainan County (TW)

(73) Assignee: Himax Analogic, Inc., Tainan County (TW)

( * ) Notice: Subject to any disclaimer, the term of this patent is extended or adjusted under 35 U.S.C. 154(b) by 289 days.

(21) Appl. No.: 12/791,964

(22) Filed: Jun. 2, 2010

(65) Prior Publication Data

US 2011/0298377 A1 Dec. 8, 2011

(51) Int. Cl.
*H05B 41/16* (2006.01)

(52) U.S. Cl. ..... 315/247; 315/307; 315/291; 315/185 S; 315/312

(58) Field of Classification Search ..... 315/247, 315/224, 225, 185 S, 291, 307–326
See application file for complete search history.

(56) References Cited

U.S. PATENT DOCUMENTS

| | | | | |
|---|---|---|---|---|
| 7,675,245 | B2 * | 3/2010 | Szczeszynski et al. | 315/291 |
| 7,675,246 | B2 * | 3/2010 | Chiang et al. | 315/291 |
| 2010/0148679 | A1 * | 6/2010 | Chen et al. | 315/185 R |

* cited by examiner

*Primary Examiner* — Tuyet Thi Vo
(74) *Attorney, Agent, or Firm* — McClure, Qualey & Rodack, LLP

(57) ABSTRACT

A LED circuit is provided. The LED circuit comprises: a plurality of LED channels, a driving module and a feedback-selecting module. The driving module supplies a driving voltage to the plurality of LED channels according to a feedback voltage. The feedback-selecting module comprises an open detection unit and a minimum-selecting unit. The open detection unit performs an open detection mechanism to separate the plurality of LED channels into a plurality of open LED channels and a plurality of non-open LED channels having an output voltage respectively. The minimum-selecting unit performs a selection mechanism to select a minimum output voltage as the feedback voltage from the output voltage of each of the plurality of non-open LED channels. A LED circuit operation method adapted in the LED circuit is provided herein as well.

12 Claims, 4 Drawing Sheets

LED CIRCUIT AND OPERATION METHOD OF THE SAME HAVING MINIMUM OUTPUT VOLTAGE SELECTION MECHANISM TO GENERATE FEEDBACK VOLTAGE

BACKGROUND

1. Technical Field

The present disclosure relates to a LED apparatus. More particularly, the present disclosure relates to a LED circuit and an operation method of the same.

2. Description of Related Art

LEDs are estimated to be four times as efficient as conventional incandescent lights. They are also claimed to be more economically sound than compact fluorescent bulbs that contain harmful mercury and are supposed to last a lot longer than conventional lighting. Thus, LEDs may become the mainstream of the lighting technology.

Feedback voltage is often used to determine the appropriate voltage or current supplied to the LEDs. Usually, the feedback voltage is from the minimal output voltage of the LEDs, which stands for the critical condition of the LEDs. The module providing the drive voltage/current receives the minimal output voltage as the feedback voltage of the LEDs to determine the operation status of the LEDs and further generates the appropriate voltage/current supplied to the LEDs. However, in a LED circuit having a plurality of LED channels, when a part of the LED channels are broken or a part of the LED channels have no LED actually existing in the channels, these LED channels are not in operation. Each of the non-operation channels forms an open circuit. The minimal output voltage, i.e. the feedback voltage, becomes 0. Consequently, the driving module may erroneously determine the operation status of the LEDs and perform unnecessary compensation mechanism.

Accordingly, what is needed is a LED circuit to determine the correct feedback voltage to maintain the operation of the LED circuit in a proper manner. The present disclosure addresses such a need.

SUMMARY

An aspect of the present disclosure is to provide a LED circuit. The LED circuit comprises: a plurality of LED channels, a driving module and a feedback-selecting module. The driving module supplies a driving voltage to the plurality of LED channels according to a feedback voltage. The feedback-selecting module comprises an open detection unit and a minimum-selecting unit. The open detection unit performs an open detection mechanism to separate the plurality of LED channels into a plurality of open LED channels and a plurality of non-open LED channels having an output voltage respectively. The minimum-selecting unit performs a selection mechanism to select a minimum output voltage as the feedback voltage from the output voltage of each of the plurality of non-open LED channels.

Another aspect of the present disclosure is to provide a LED circuit. The LED circuit comprises: a plurality of LED channels, a driving module and a feedback-selecting module. The driving module supplies a driving voltage to the plurality of LED channels according to a feedback voltage. The feedback-selecting module comprises an open detection unit and a minimum-selecting unit. The open detection unit performs an open detection mechanism to separate the plurality of LED channels into a plurality of open LED channels and a plurality of non-open LED channels having an output voltage respectively. The minimum-selecting unit comprises a plurality of inputs and a comparing module. Each of the inputs is selectively connected to a high voltage higher than a predetermined value or one of the corresponding LED channel such that a first part of the inputs corresponding to the non-open LED channels are connected to the non-open LED channels to receive the output voltage respectively and a second part of the inputs corresponding to the open LED channels are connected to the high voltage. The comparing module compares the output voltages and the high voltages to generate a comparison result. The minimum-selecting unit selects a minimum output voltage from the output voltages and the high voltages as the feedback voltage according to the comparison result.

Yet another aspect of the present disclosure is to provide a LED circuit operation method adapted in a LED circuit, wherein the LED circuit comprises a plurality of LED channels and a driving module. The LED circuit operation method comprises the steps as follow. The driving module is provided to supply a driving voltage to the plurality of LED channels according to a feedback voltage. An open detection mechanism is performed to separate the plurality of LED channels into a plurality of open LED channels and a plurality of non-open LED channels having an output voltage respectively. A selection mechanism is performed to select a minimum output voltage as the feedback voltage from the output voltage of each of the plurality of non-open LED channels.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
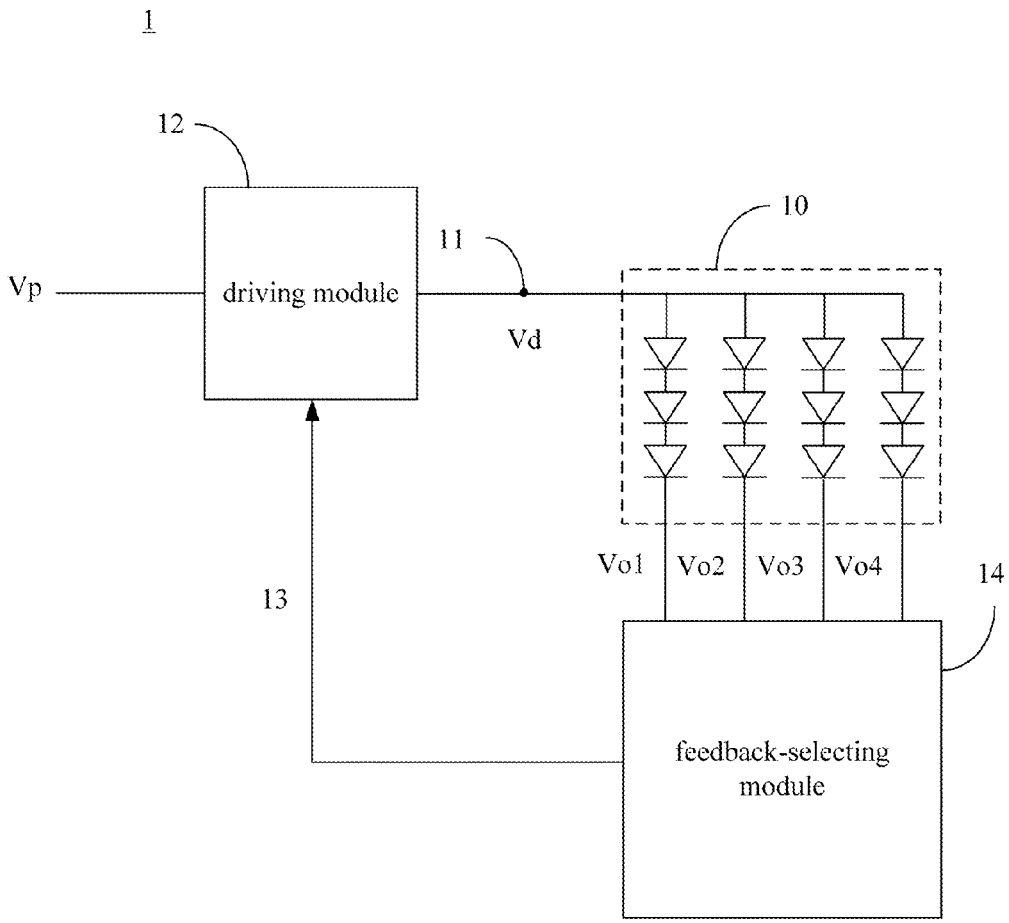
FIG. 1 is a diagram of a LED circuit of an embodiment of the present disclosure.

Reference will now be made in detail to the present embodiments of the disclosure, examples of which are illustrated in the accompanying drawings. Wherever possible, the same reference numbers are used in the drawings and the description to refer to the same or like parts.

Please refer to FIG. 1. FIG. 1 is a diagram of a LED circuit 1 of an embodiment of the present disclosure. The LED circuit 1 comprises a plurality of LED channels 10, a driving module 12 and a feedback-selecting module 14.

Figure 2:
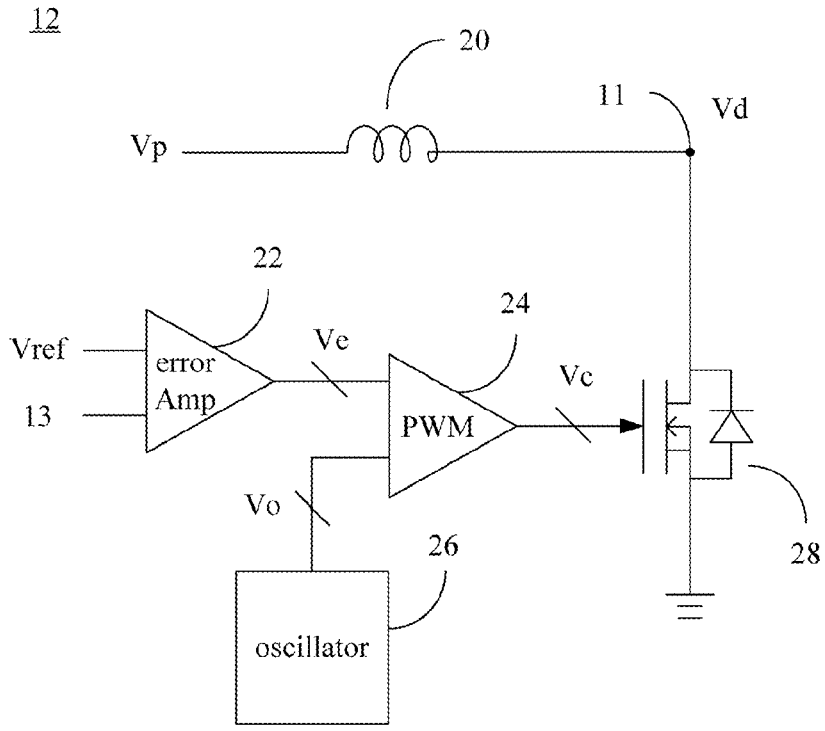
FIG. 2 is a diagram of the driving module of an embodiment of the present disclosure.

The driving module 12 is a DC-to-DC converter that supplies a driving voltage Vd to a first node 11 based on the feedback voltage 13 in the present embodiment. Please refer to FIG. 2 at the same time. FIG. 2 shows the driving module 12 of an embodiment of the present disclosure. The driving module 12 comprises an inductor 20, an error amplifier 22, a pulse width modulator 24, an oscillator 26 and a power MOS 28. The error amplifier 22 receives a reference voltage Vref and the feedback voltage 13 to generate an error voltage Ve. Substantially, the error amplifier 22 generates the error voltage Ve according to a difference of the reference voltage Vref and the feedback voltage 13. Generally, the reference voltage Vref is a fixed value. In accordance, both the feedback voltage 13 and the difference generated according to the feedback voltage 13 indicate an operation status of the LED channels 10. The pulse width modulator 24 receives an oscillating voltage Vo from the oscillator 26 and the error voltage Ve to make a comparison to generate a control voltage Vc. The active and the inactive period of the control voltage Vc determines when to enable the power MOS 28 and when to disable the power MOS 28. As a result, the power MOS 28 turns on and off according to the control voltage Vc to generate the driving voltage Vd to the node 11. The inductor 20 further stabilizes the voltage Vd of the node 11. It is noticed that in other embodiments, other suitable driving modules with the feedback mechanism can be used as well.

Each of the LED channels 10 may comprise a plurality of LEDs, as depicted in FIG. 1. In the present embodiment, there are four LED channels. However, in other embodiments, the number of the LED channels can be different. The driving voltage Vd of the node 11 from the driving module 12 is supplied to each of the LED channels 10. Therefore, each of the LED channels 10 can generate an output voltage when operating, wherein in the present embodiment, four output voltages Vo1-Vo4 are generated. Each output voltage represents the operation status of the corresponding LED channel. The minimal output voltage of the LED channels 10 usually stands for the critical condition of the LED channels 10 and is sent back to the driving module 12 as the feedback voltage 13, such that the driving module 12 is able to generate a driving voltage Vd that has an appropriate level according to the operation status of the LED channels 10.

However, there can be only a part of the LED channels in operation. When the LED channel is broken or no LED is present in the LED channel, the LED channel forms an open circuit. For example, if two of the LED channels that generate the output voltages Vo1 and Vo3 are broken, the two LED channels form two open circuits. Each of the output voltages Vo1 and Vo3 of the two open circuits is 0. Consequently, the minimal output voltage that acts as the feedback voltage becomes 0 as well, which is smaller than the output voltages of the remaining LED channels that are really in operation (i.e. the non-open LED channels). The feedback voltage generated from the above procedure cannot stand for the actual operation status of the whole LED channels 10.

Figure 3:
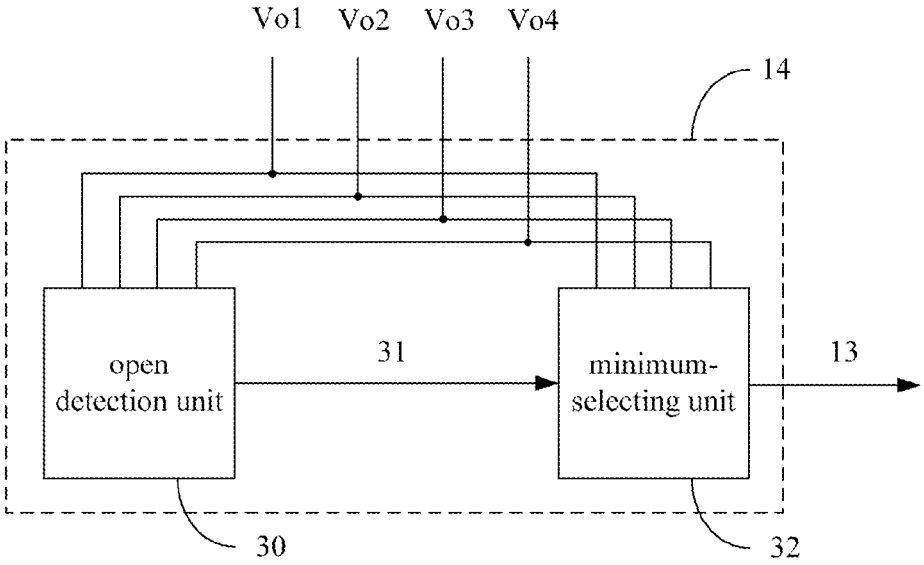
FIG. 3 is a diagram of the feedback-selecting module of an embodiment of the present disclosure.

Please refer to FIG. 3 at the same time. FIG. 3 is the feedback-selecting module 14 of an embodiment of the present disclosure. The feedback-selecting module 14 comprises an open detection unit 30 and a minimum-selecting unit 32. The open detection unit 30 receives the output voltages Vo1 to Vo4 and performs an open detection mechanism according to the output voltages Vo1 to Vo4 to separate the plurality of LED channels 10 into a plurality of open LED channels (e.g. the LED channels generate the output voltage Vo1 and Vo3 in the present embodiment) and a plurality of non-open LED channels (e.g. the LED channels generate the output voltage Vo2 and Vo4 in the present embodiment) respectively. The open detection mechanism can be performed with various kinds of conventional technologies. Therefore, no further detail is described herein.

A detection result 31 is obtained after the detection of the open detection unit 30. The detection result 31 is sent to the minimum-selecting unit 32. In the present embodiment, the minimum-selecting unit 32 has a plurality of inputs selectively connected to a high voltage higher than a predetermined value or one of the corresponding LED channel. In the present embodiment, "selectively connected" means that each of the inputs is connected to one of the LED channels 10 respectively, as is the open detection unit 30, and is connected to the high voltage as well. However, which voltage the inputs actually receive depends on different situations. The inputs can be separated into a first part and a second part according to the detection result 31, wherein the first part is corresponding to the non-open LED channels and the second part is corresponding to the open LED channels.

When the LED channels are in operation (e.g. the LED channels generate the output voltage Vo2 and Vo4 in the present embodiment), the corresponding inputs (e.g. the first part of the inputs) of the minimum-selecting unit 32 receives the output voltages Vo2 and Vo4. When the LED channels are not in operation (e.g. the LED channels generate the output voltage Vo1 and Vo3 in the present embodiment), the detection result 31 makes each of the corresponding inputs (e.g. the second part of the inputs) of the minimum-selecting unit 32 receive the high voltage having a voltage level higher than a predetermined value. In an embodiment, the high voltage is the supply voltage of the LED circuit that has the highest voltage level in the LED circuit. As a result, the minimum-selecting unit 32 is able to omit the high voltage corresponding to the LED channels that are not in operation and only has to select the minimal output voltage from the remaining output voltage (i.e. the output voltages Vo2 and Vo4 in the present embodiment).

Figure 4A:
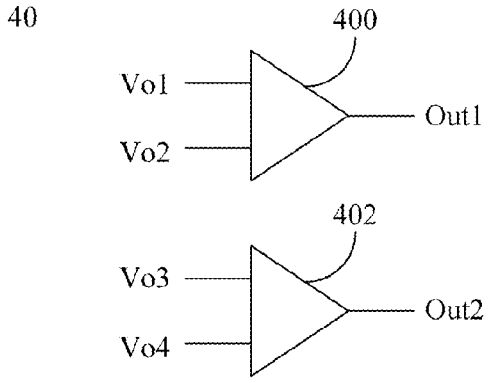
FIG. 4A is a diagram depicting the first comparison stage of the comparing module in FIG. 1.

In an embodiment, the minimum-selecting unit 32 comprises a comparing module that has a plurality of comparison stages such that the selection mechanism is performed according to the comparison result of the comparing module. Please refer to FIG. 4A. FIG. 4A is a diagram depicting a first comparison stage 40 of the comparing module. In the first comparison stage 40, the output voltages Vo1 and Vo2 are compared in a comparator 400, and the output voltages Vo3 and Vo4 are compared in another comparator 402 at the same time. In the present embodiment, due to the high voltages supplied for the reason described above, a first comparison result Out1 shows that the output voltage Vo2 is smaller than the output voltage Vo1, whereas the first comparison result Out2 shows that the output voltage Vo4 is smaller than the output voltage Vo3. Though a comparison is made, the high voltage supplied to the minimum-selecting unit 32 can be viewed as a signal that makes the minimum-selecting unit 32 omit the corresponding open LED channel as well.

Figure 4B:
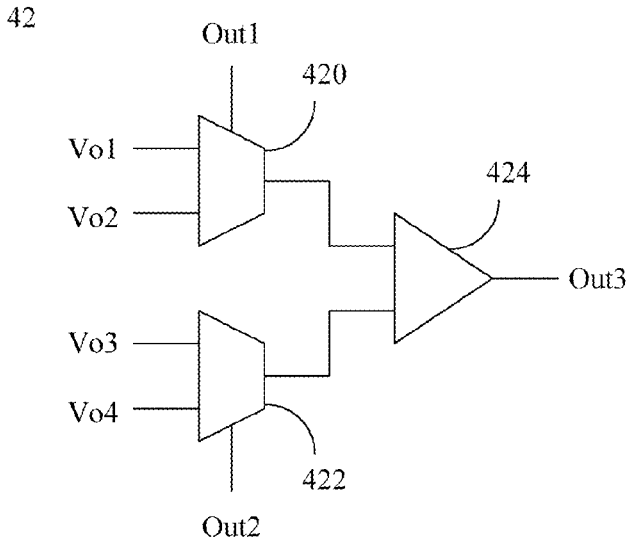
FIG. 4B is a diagram of the second comparison stage of the comparing module in FIG. 1.

Subsequently, according to the first comparison result Out1 and Out2, only the output voltage Vo2 and Vo4 need to be compared in a second comparison stage. Please refer to FIG. 4B. FIG. 4B is a diagram of the second comparison stage 42 of the comparing module. The output voltages Vo2 and Vo4 are chosen according to two multiplexers 420 and 422. Further, output voltages Vo2 and Vo4 are compared by the comparator 424 to generate a second comparison result Out3. The second comparison result Out3 thus determines the minimal output voltage of the LED channels that are actually in operation (i.e. the non-open LED channels).

Figure 4C:
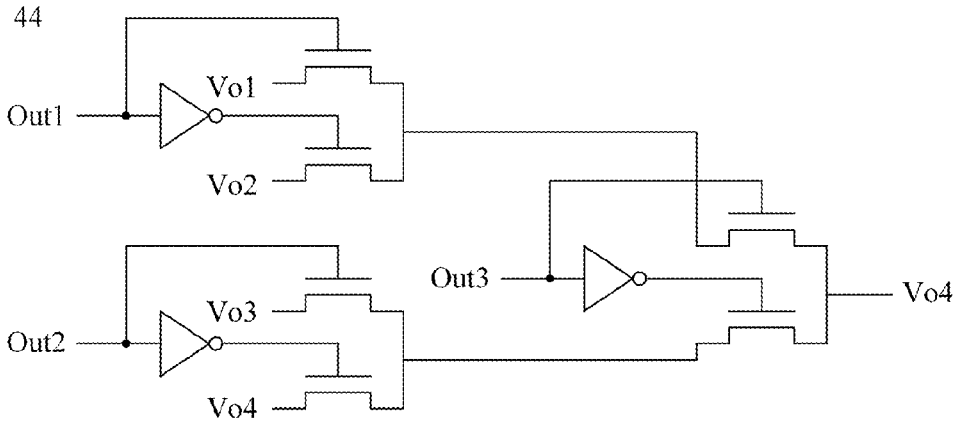
FIG. 4C is a diagram of the selection stage of the comparing module in FIG. 1.

Please refer to FIG. 4C. FIG. 4C is a diagram of the selection stage 44 of the comparing module. The selection stage 44 comprises a plurality of transmission gate controlled by the first and the second comparison results Out1, Out2 and Out3. As a result, the selection stage 44 can select the minimal output voltage from the high voltages and the output voltages according to the first and the second comparison results Out1, Out2 and Out3. Supposed that the output voltage Vo4 is the minimal output voltage, then the output voltage Vo4 is selected as the feedback voltage 13 and is sent back to the driving module 12.

It is noticed that in other embodiments, other suitable selection mechanisms can be used as well.

The LED circuit 1 provided in the present disclosure is able to detect the LED channels that are actually in operation and select the minimal output voltage from the non-open LED channels to avoid the erroneous judgment of the feedback voltage.

Figure 5:
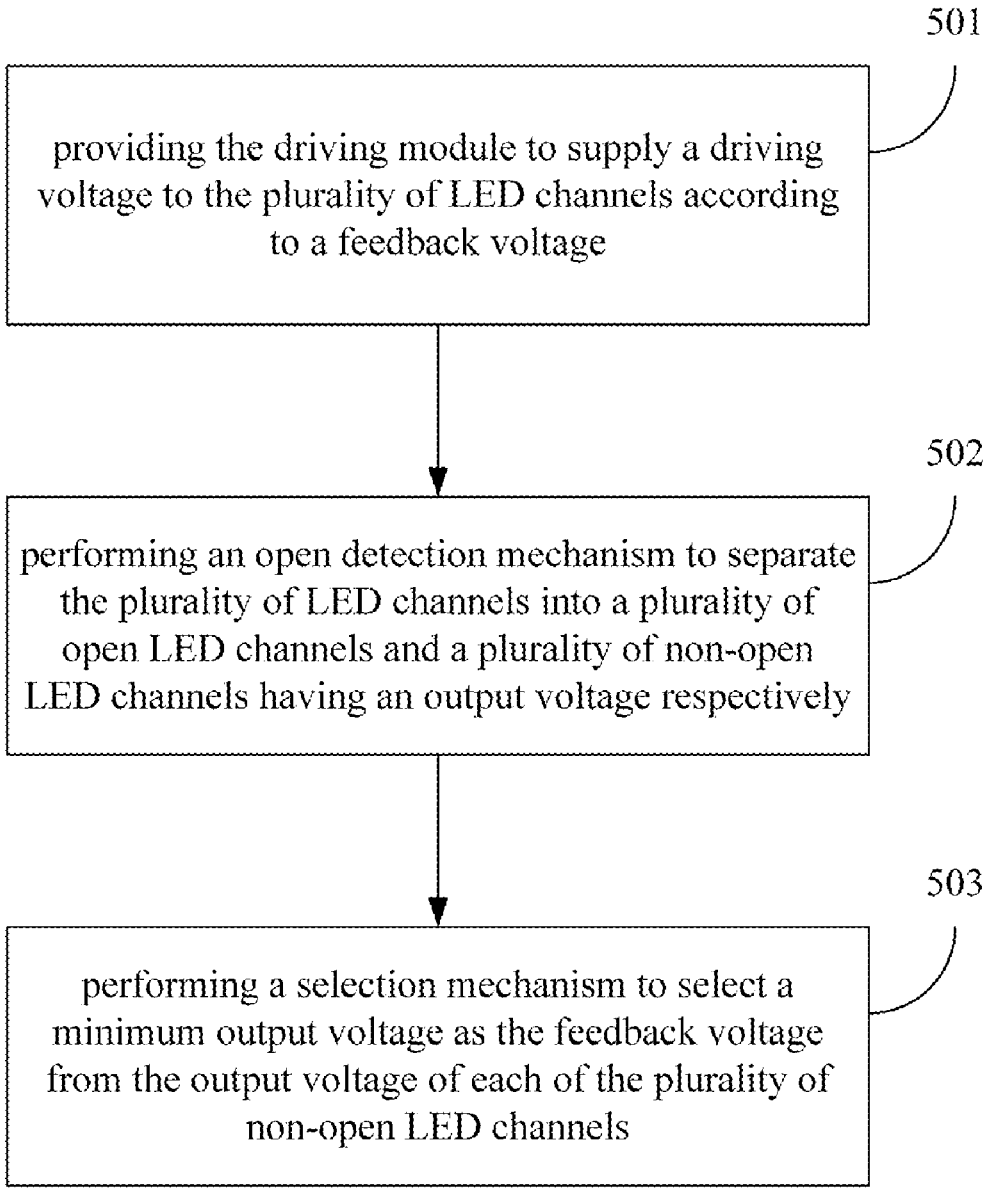
FIG. 5 is a flow chart of a LED circuit operation method in another embodiment of the present disclosure.

Please refer to FIG. 5. FIG. 5 is a flow chart of a LED circuit operation method in another embodiment of the present disclosure. The LED circuit operation method can be adapted in the LED circuit 1 depicted in FIG. 1. The LED circuit operation method comprises the steps as follows. (The steps are not recited in the sequence in which the steps are performed. That is, unless the sequence of the steps is expressly indicated, the sequence of the steps is interchangeable, and all or part of the steps may be simultaneously, partially simultaneously, or sequentially performed).

In step 501, the driving module 12 is provided to supply a driving voltage Vd to the plurality of LED channels 10 according to a feedback voltage 13. Then in step 502, an open detection mechanism is performed to separate the plurality of LED channels 10 into a plurality of open LED channels and a plurality of non-open LED channels having an output voltage respectively. Afterward, a selection mechanism is performed to select a minimum output voltage as the feedback voltage from the output voltage of each of the plurality of non-open LED channels in step 503.

The advantage of the LED circuit and the operation method of the same present disclosure is able to detect the LED channels that are actually in operation and select the minimal output voltage from the non-open LED channels to avoid the erroneous judgment of the feedback voltage.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A LED circuit comprising:
a plurality of LED channels;
a driving module to supply a driving voltage to the plurality of LED channels according to a feedback voltage; and
a feedback-selecting module comprising:
an open detection unit connected to the plurality of LED channels to perform an open detection mechanism to separate the plurality of LED channels into a plurality of open LED channels and a plurality of non-open LED channels having output voltages respectively; and
a minimum-selecting unit to perform a selection mechanism to select a minimum output voltage as the feedback voltage from the output voltage of each of the plurality of non-open LED channels, wherein the minimum-selecting unit comprises:
a plurality of inputs, wherein a first part of the inputs corresponding to the non-open LED channels are connected to the non-open LED channels to receive the output voltage respectively and a second part of the inputs corresponding to the open LED channels are connected to a high voltage higher than a predetermined value respectively when the selection mechanism is performed; and
a comparing module, wherein the selection mechanism is performed according to a comparison result of the output voltages of the plurality of non-open LED channels with the comparing module.

2. The LED circuit of claim 1, wherein the high voltage is a supply voltage of the LED circuit.

3. The LED circuit of claim 1, wherein the driving module further receives a reference voltage and the driving module substantially provides the driving voltage to the plurality of LED channels according to the feedback voltage and the reference voltage.

4. The LED circuit of claim 1, wherein the driving module is a DC-to-DC converter.

5. A LED circuit comprising:
a plurality of LED channels;
a driving module to supply a driving voltage to the plurality of LED channels according to a feedback voltage; and
a feedback-selecting module comprising:
an open detection unit connected to the plurality of LED channels to perform an open detection mechanism to separate the plurality of LED channels into a plurality of open LED channels and a plurality of non-open LED channels having output voltages respectively; and
a minimum-selecting unit comprising:
a plurality of inputs each selectively connected to a high voltage higher than a predetermined value or one of the corresponding LED channel such that a first part of the inputs corresponding to the non-open LED channels receives the output voltage respectively and a second part of the inputs corresponding to the open LED channels receives the high voltage; and
a comparing module to compare the output voltages and the high voltages to generate a comparison result;
wherein the minimum-selecting unit selects a minimum output voltage from the output voltages and the high voltages as the feedback voltage according to the comparison result.

6. The LED circuit of claim 5, wherein the high voltage is a supply voltage of the LED circuit.

7. The LED circuit of claim 5, wherein the driving module further receives a reference voltage and the driving module substantially provides the driving voltage to the plurality of LED channels according to the feedback voltage and the reference voltage.

8. The LED circuit of claim 5, wherein the driving module is a DC-to-DC converter.

9. A LED circuit operation method adapted in a LED circuit, wherein the LED circuit comprises a plurality of LED channels and a driving module, the LED circuit operation method comprises the steps of:
providing the driving module to supply a driving voltage to the plurality of LED channels according to a feedback voltage;
performing an open detection mechanism to separate the plurality of LED channels into a plurality of open LED channels and a plurality of non-open LED channels having an output voltage respectively; and
performing a selection mechanism to select a minimum output voltage as the feedback voltage from the output voltage of each of the plurality of non-open LED channels, wherein the selection mechanism is performed by a minimum-selecting unit comprising:
a plurality of inputs selectively connected to a high voltage higher than a predetermined value or one of the corresponding LED channel such that a first part of the inputs corresponding to the non-open LED channels are connected to the non-open LED channels to receive the output voltage respectively and a second part of the inputs corresponding to the open LED channels are connected to the high voltage; and a comparing module to compare the output voltages and the high voltages to generate a comparison result, wherein the minimum-selecting unit selects a minimum output voltage from the output voltages and the high voltages as the feedback voltage according to the comparison result.

10. The LED circuit operation method of claim 9, wherein the high voltage is a supply voltage of the LED circuit.

11. The LED circuit operation method of claim 9, wherein the driving module further receives a reference voltage and the driving module substantially provides the driving voltage to the plurality of LED channels according to the feedback voltage and the reference voltage.

12. The LED circuit operation method of claim 9, wherein the driving module is a DC-to-DC converter.

* * * * *